US009700782B2

(12) United States Patent
McCrane

(10) Patent No.: US 9,700,782 B2
(45) Date of Patent: Jul. 11, 2017

(54) PULLED PALM GLOVE

(75) Inventor: David Patrick McCrane, Napa, CA (US)

(73) Assignee: Implus Footcare, LLC, Durham, NC (US)

( * ) Notice: Subject to any disclaimer, the term of this patent is extended or adjusted under 35 U.S.C. 154(b) by 1696 days.

(21) Appl. No.: 12/842,411

(22) Filed: Jul. 23, 2010

(65) Prior Publication Data

US 2012/0017351 A1 Jan. 26, 2012

(51) Int. Cl.

*A63B 71/14* (2006.01)
*A63B 21/00* (2006.01)
*A63B 21/06* (2006.01)

(52) U.S. Cl.

CPC ..... *A63B 71/141* (2013.01); *A63B 21/4019* (2015.10); *A63B 21/4035* (2015.10); *A63B 21/06* (2013.01)

(58) Field of Classification Search

USPC ..... 2/159, 160, 161.1, 161.2, 161.3, 161.6, 2/161.8, 162; 482/44, 47, 49, 50; 602/21, 60, 64

See application file for complete search history.

(56) References Cited

U.S. PATENT DOCUMENTS 4,691,387 A * 9/1987 Lopez ..... 2/161.3
5,033,120 A * 7/1991 Myers ..... 2/161.3
5,182,814 A * 2/1993 Christensen ..... 2/161.1
5,217,029 A * 6/1993 Shields ..... 128/879
5,353,440 A 10/1994 Meldeau
5,435,013 A * 7/1995 Davis ..... 2/161.1
5,557,806 A 9/1996 Caswell et al.
5,608,912 A * 3/1997 Cumberland ..... 2/16
5,740,555 A 4/1998 Renegar
5,765,228 A * 6/1998 Bieling ..... 2/158
5,819,313 A * 10/1998 McCrane ..... 2/16
5,826,276 A * 10/1998 Garceau-Verbeck ..... 2/161.1
6,141,801 A * 11/2000 Helenick ..... 2/159
6,658,669 B1 * 12/2003 Addington et al. ..... 2/161.1
6,704,939 B2 3/2004 Faulconer
6,834,397 B1 12/2004 Murphy
7,008,355 B2 * 3/2006 Emick ..... 482/139
7,475,433 B2 1/2009 Coulter et al.
7,530,120 B2 * 5/2009 Morrow et al. ..... 2/161.1
7,565,703 B2 7/2009 Avis et al.
2003/0051285 A1 3/2003 Bower
2008/0104737 A1 5/2008 Shepherd
2008/0263748 A1 10/2008 Avis et al.
2008/0282445 A1 * 11/2008 Taliento et al. ..... 2/161.3
2009/0012438 A1 * 1/2009 Frangi ..... 602/21
2009/0070917 A1 3/2009 Shoemaker
2009/0094730 A1 * 4/2009 Cheng ..... 2/161.2
2009/0275418 A1 11/2009 Whitehead, II et al.
2009/0313742 A1 * 12/2009 Smeltzer ..... 2/161.2
2009/0320178 A1 12/2009 Faulconer (Continued)

*Primary Examiner* — Clinton T Ostrup
*Assistant Examiner* — Andrew W Sutton
(74) *Attorney, Agent, or Firm* — Edward S. Wright

(57) ABSTRACT

Glove for gripping an object having a palm section that overlies the palm side of the hand, a back section that overlies the back of the hand, stalls for receiving the fingers and thumb, and a tab extending from the lower margin of the palm section which can be pulled in a downward direction to tension the palm section, and means for holding the tab in a pulled position to maintain tension in the palm section.

32 Claims, 6 Drawing Sheets

(56) References Cited

U.S. PATENT DOCUMENTS

| | | | | |
|---|---|---|---|---|
| 2010/0077533 | A1* | 4/2010 | Munda | 2/161.1 |
| 2011/0046530 | A1* | 2/2011 | Gaylord et al. | 602/21 |
| 2012/0017351 | A1* | 1/2012 | McCrane | 2/161.1 |

* cited by examiner

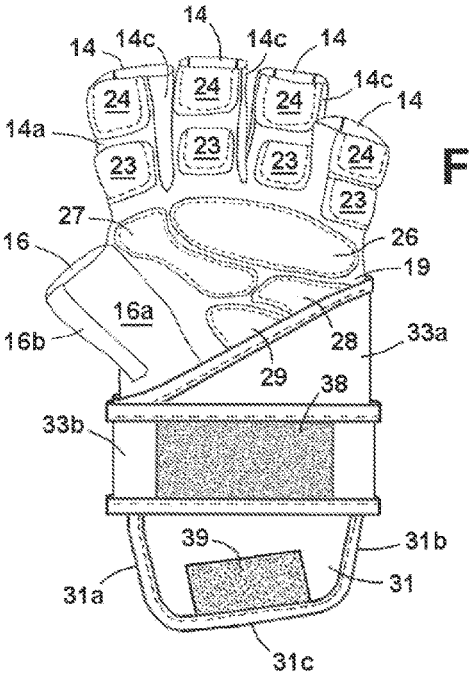
Fig. 4
Fig. 3
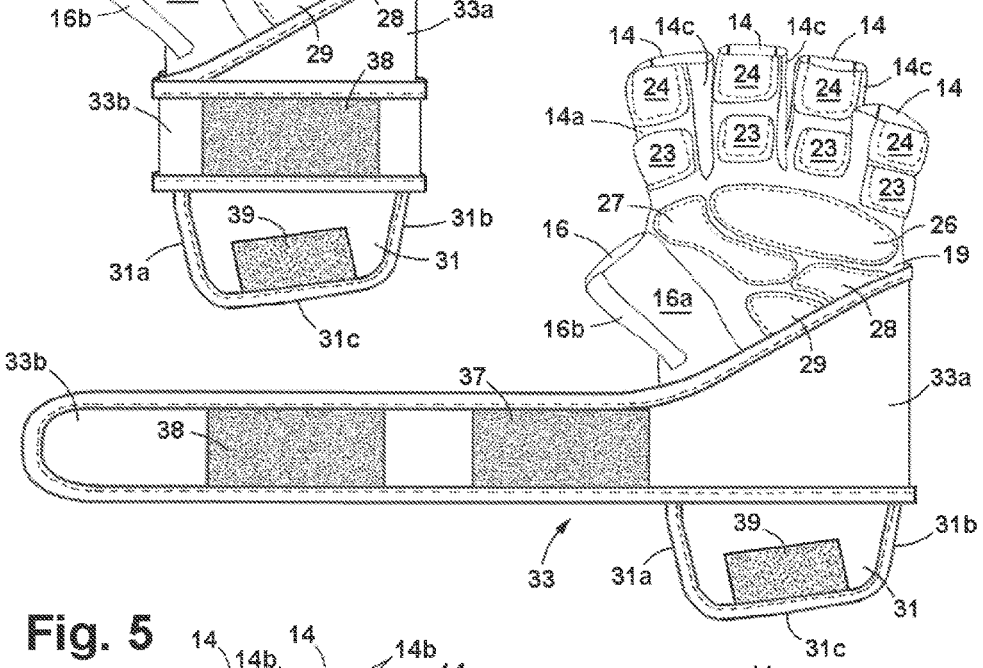
Fig. 5
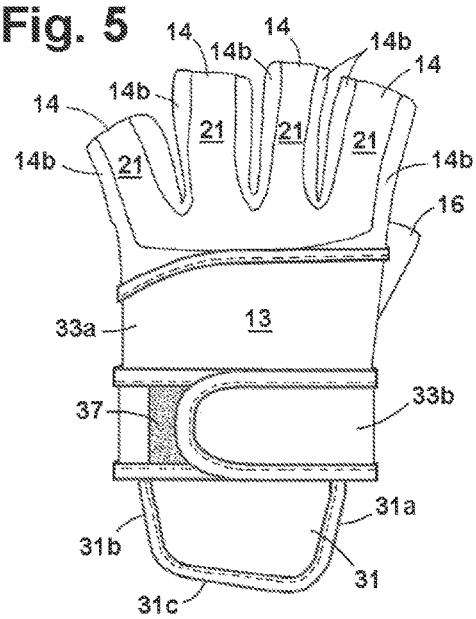
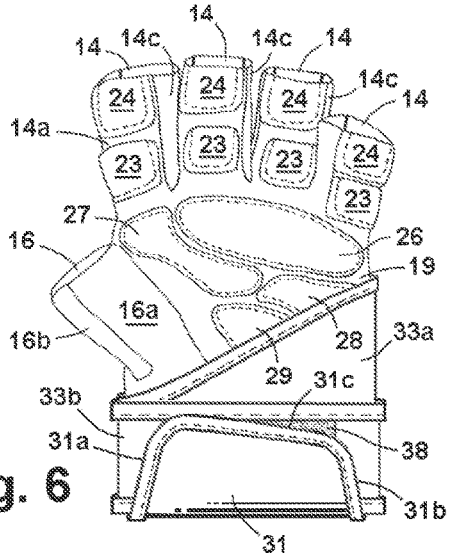
Fig. 6

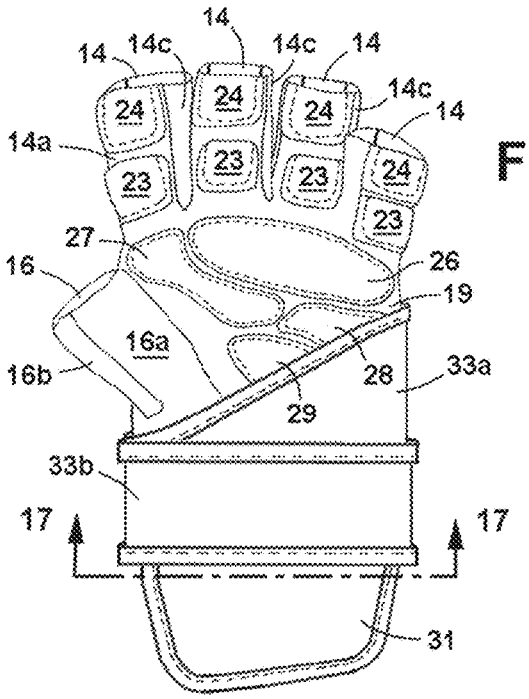
Fig. 16
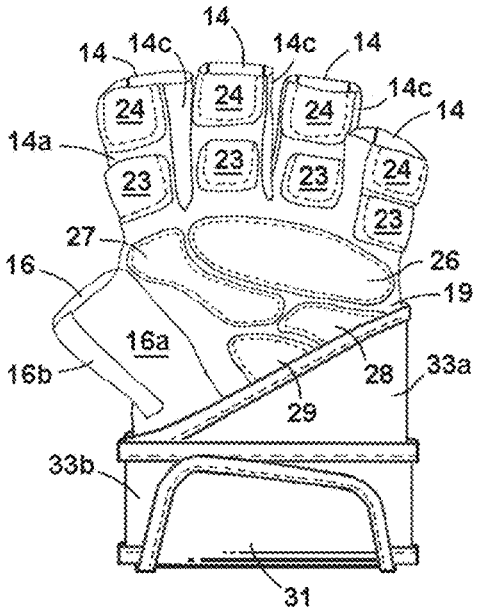
Fig. 18
Fig. 17
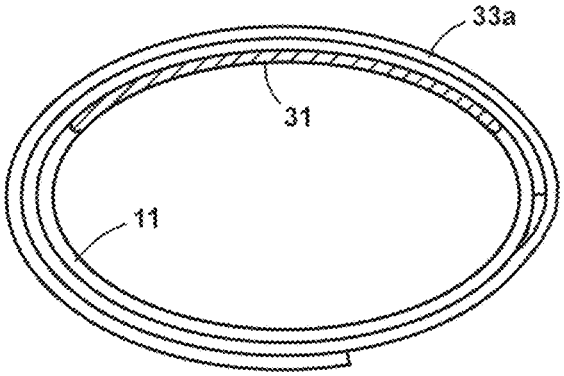
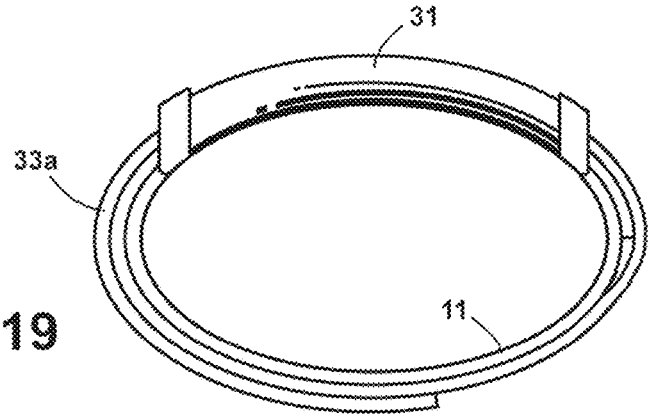
Fig. 19

PULLED PALM GLOVE

BACKGROUND OF THE INVENTION

Field of Invention

This invention pertains generally to gloves and, more particularly, to a glove for use by a person engaging in an activity such as weightlifting and other activities in which an object is gripped by the hand.

Related Art

People engaging in activities such as weightlifting where the grip on an object is important commonly use gloves to protect their hands and to get a better grip on the object. A common problem with such gloves is a bunching or gathering of the material between the hand and the object when the hand is wrapped about an object such as the bar of a barbell or dumbbell. Such bunching or gathering prevents a person from getting a firm, continuous grip on the object.

OBJECTS AND SUMMARY OF THE INVENTION

It is, in general, an object of the invention to provide a new and improved glove for use by a person engaging in an activity such as weightlifting and other activities in which an object is gripped by the hand.

Another object of the invention is to provide a glove of the above character which overcomes the limitations and disadvantages of gloves heretofore provided for such use.

These and other objects are achieved in accordance with the invention by providing a glove for gripping an object having a palm section that overlies the palm side of the hand of person wearing the glove, a back section that overlies the back of the hand, stalls for receiving the fingers and thumb, and a tab extending from the lower margin of the palm section which can be pulled in a downward direction to tension the palm section, and means for holding the tab in a pulled position to maintain tension in the palm section.

BRIEF DESCRIPTION OF THE DRAWINGS

FIG. 3 is a front isometric view of the embodiment of FIG. 1 with the wrist band partially wrapped about the body of the glove.

FIG. 4 is a front isometric view of the embodiment of FIG. 1 with the wrist band fully wrapped about the body of the glove.

FIG. 5 is a rear isometric view of the embodiment of FIG. 1 with the wrist band wrapped about the body of the glove.

FIG. 6 is a front isometric view of the embodiment of FIG. 1 with the palm tensioning tab secured to the wrist band.

FIG. 16 is a front isometric view of another embodiment of a glove incorporating the invention, with the wrist band wrapped about the body of the glove and the tensioning tab unfastened.

FIG. 17 is a cross-sectional view taken along line 17-17 in FIG. 16.

FIG. 18 is a front isometric view of the embodiment of FIG. 16, with the tensioning tab folded over the wrist band.

FIG. 19 is a bottom plan view of the embodiment of FIG. 16, with the tensioning tab folded over the wristband.

DETAILED DESCRIPTION

Figure 1:
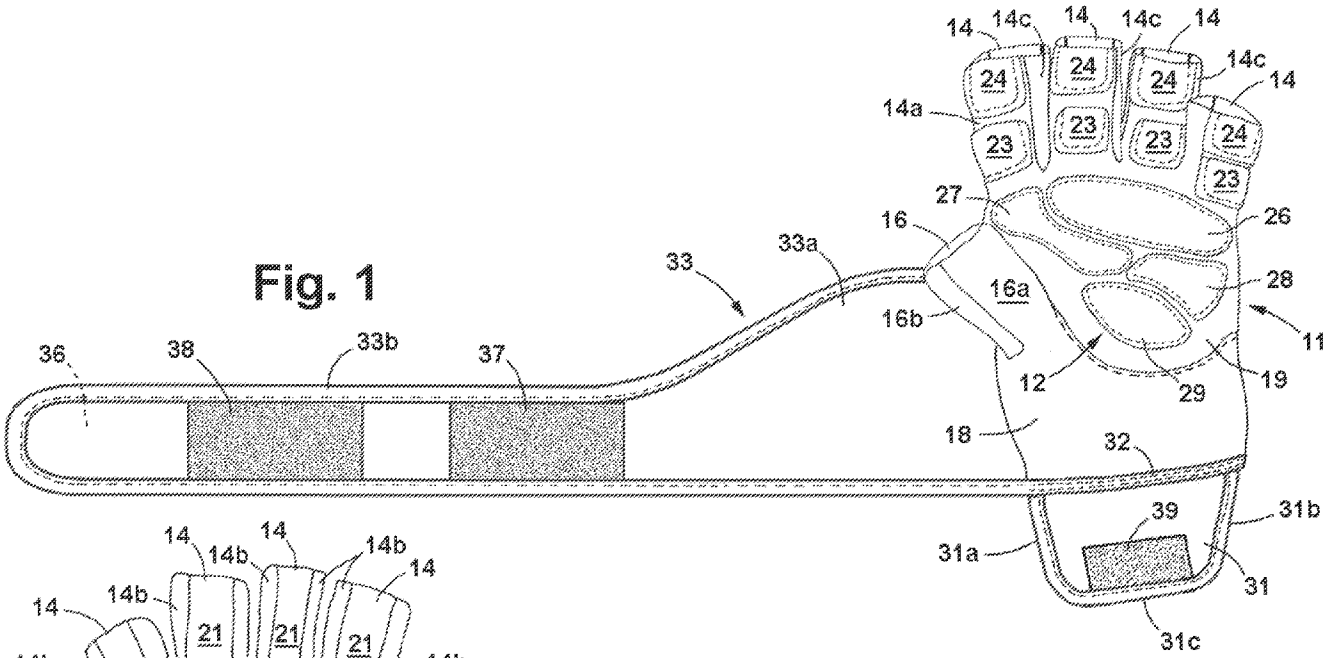
FIG. 1 is a front isometric view of one embodiment of a glove incorporating the invention.
Figure 2:
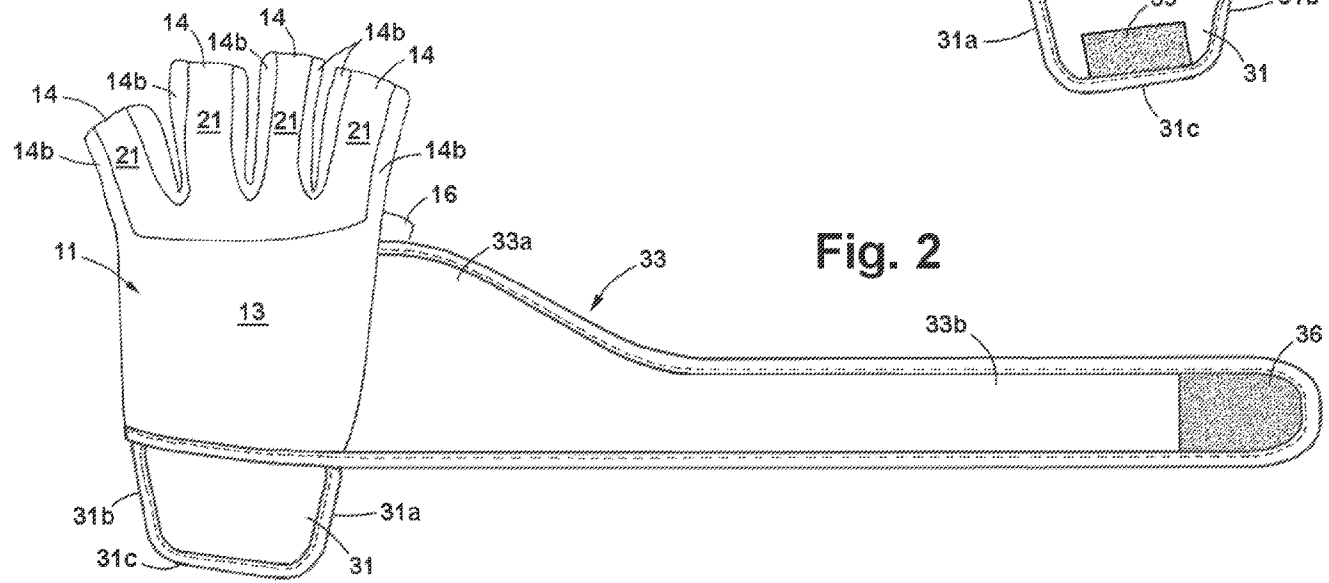
FIG. 2 is a rear elevational view of the embodiment of FIG. 1.

As illustrated in FIG. 1, the glove has a body 11 with a palm or front side 12 and a back side 13 which are shaped to conform generally to the palm and to the back of the user's hand. Finger stalls 14 extend from the upper portion of the body, and a thumb stall 16 extends from the front. The palm section has a lower section 18 fabricated of a non-stretchable material such as leather and an upper section 19 fabricated of a relatively thin, highly elastic or stretchable material such as a Lycra® fabric or other suitable polyester. The front portions 14*a* of the finger stalls are fabricated of the same stretchable material as the upper palm section, and the front portion 16*a* of the thumb stall is fabricated of the same non-stretchable material as the lower portion of the palm section. The back of the glove 13, the backs of the finger stalls 14*b*, the sides of the finger stalls 14*c*, and the back of the thumb stall 16*b* are fabricated of a stretchable material such as spandex, with leather sections 21 over the stretchable material on the backs of the finger stalls.

Pads are provided on the fronts of the finger stalls and on the palm section of the glove to further enhance the grip on the object. Thus, pads 23 and 24 are attached to finger stalls 14 in position to overlie the lower and middle sections of the four fingers, and pads 26-29 are attached to the upper palm section 19 in position to overlie the fleshier areas of the palm.

In a presently preferred embodiment, the pads on the finger stalls and the upper part of the palm contain a moldable, clay-like substance that is substantially non-compressible and retains its shape without hardening. Being malleable and readily reshapable, the material fills in gaps between the fleshy parts of the fingers and palm and provides a substantially continuous gripping surface for engagement with a cylindrical object about which the hand is curled. The material is preferably one which is also cohesive and non-oozing such that it does not require a liquid-tight bladder to contain it. The two pads on the lower part of the palm contain a resilient foam material, although they can also be filled with the moldable, clay-like material instead of the foam, if desired. Such pads and their use on gloves for gripping objects are described and illustrated in greater detail in copending application Ser. No. 12/842,362, filed of even date, the disclosure of which is incorporated herein by reference.

The pads on the finger stalls and the pads on the palm section are spaced apart along lines that correspond generally to the joint lines of the fingers and palm of the person wearing the glove, with the flexible material between the pads forming living hinges between the pads. The spacing between the pads is such that when the hand is curled about the object such as a bar, the thin, stretchable material connecting the pads flexes, allowing adjacent portions of the pads to come together and form a substantially continuous gripping surface that matches the contour of the bar. At the same time, the moldable material fills the voids between the fleshy parts of the palm and fingers, thereby providing a firm, solid grip between the hand and the bar, with only the leather portions of the glove contacting the bar.

A tab 31 for tensioning the palm section of the glove extends from the lower edge of the front side of the glove. In the embodiment illustrated, the tab is a separate piece of substantially non-stretchable material such as leather which is attached to the lower edge portion of lower palm section 18 by stitching 32. However, it could just as well be formed integrally with the palm section, if desired. Pulling on the tab stretches the elastic material in upper palm section 19, thereby tensioning the palm section and drawing the hand toward a curled position to facilitate gripping of an object and minimizing excess material in the palm when gripping the object.

As can be seen in FIGS. 1-5, tab 31 hangs freely from the lower edge of the palm section and is generally trapezoidal in shape, with downwardly and inwardly inclined side edges 31*a*, 31*b*, and a lower edge 31*c* which is generally parallel to the lower edge of the palm section.

A support strap or wrap 33 is attached to the body of the glove and wrapped around the hand and wrist of the user to provide support for the hand and wrist as well as keeping the glove in place on the hand. The wrap has a tapered section 33*a* that extends laterally from the thumb side of the glove body and an elongated strap section 33*b* that extends from the free end of the tapered section. The taper begins at the top of the palm section and continues for a distance sufficient to wrap around the back side and the palm side of the hand, ending at a point just below the base of the thumb, with substantially the entire upper palm section being exposed for gripping an object.

Hook and loop fasteners 36, 37 such as those marketed under the Velcro trademark are attached to the strap section of the wrist band for securing the strap about the wrist of the user. In the embodiment illustrated, hook fastener 36 is on the inner or back side of the strap near the free end, and loop fastener 37 is on the outer or front side near the tapered section.

A second loop fastener 38 is mounted on the outer or front side of the strap section for engagement with a hook fastener 39 on the front side of tensioning tab 31. Fastener 38 is located toward the free end of the strap section in position to overlie the front side of the wrist adjacent to the tab.

In use, a person inserts his hand into the body of the glove with the fingers and thumb being received in the finger and thumb stalls, To tension the palm section, the wearer pulls the tab 31, bending the palm and flexing the wrist forward until the desired tension is reached. Once the glove is on the hand and the palm is pretensioned, the wearer wraps the wrist band across the back of his hand, then across the front, as illustrated in FIG. 3. As he continues wrapping the strap about the lower portion of the tapered section and about his wrist, Velcro® pad 37 aligns with and faces outwardly from the back side of the wrist, and pad 38 aligns with and faces outwardly from the front side, as seen in FIG. 4. The strap is secured about by wrist by engaging the hook fastener 36 at the end of the strap with the loop fastener 37 on the back of the wrist, as shown in FIG. 5.

Once the band 33 is secured, the user then folds the tab 31 up and over the wrist band and engages hook fastener 39 with loop fastener 38 to secure the tab to the wrist band, as illustrated in FIG. 6, to maintain the desired tension in the palm section.

Figure 7:
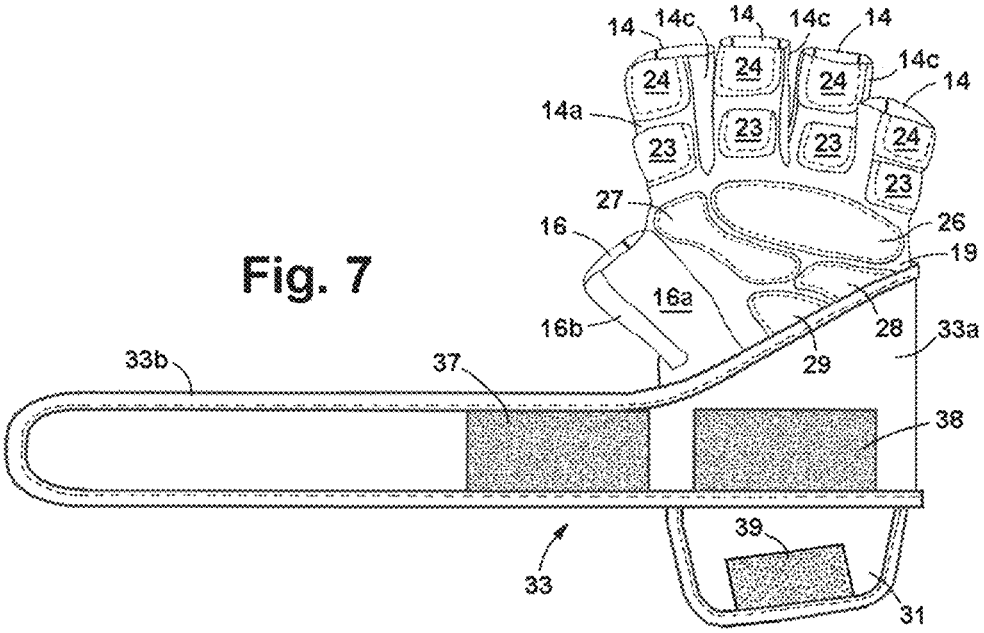
FIG. 7 is a front isometric view of another embodiment of a glove incorporating the invention with the wrist band partially wrapped about the body of the glove.
Figure 8:
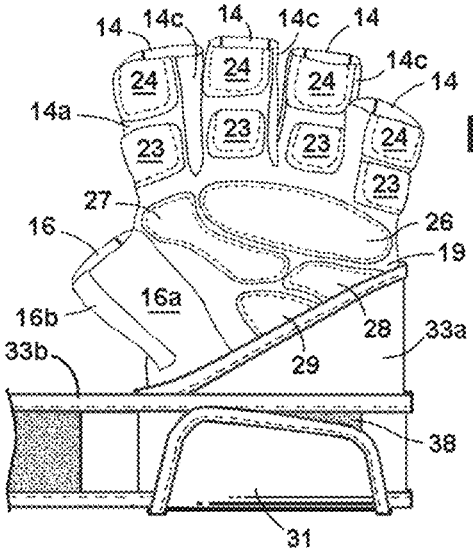
FIG. 8 is a front isometric view of the embodiment of FIG. 7 with the wrist band partially wrapped about the body of the glove and the tensioning tab secured to the wrist band.
Figure 9:
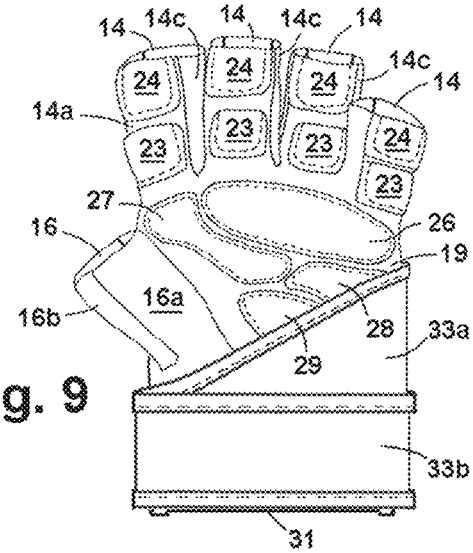
FIG. 9 is a front isometric view of the embodiment of FIG. 7 with the wrist band fully wrapped about the body of the glove.

The embodiment illustrated in FIGS. 7-9 is similar to the embodiment of FIGS. 1-6, and like reference numerals designate corresponding elements in the two. The only difference is in the placement of one of the Velcro® fasteners and the manner in which the tensioning tab is secured to the wrist band.

In this embodiment, the loop fastener 38 for tensioning tab 31 is positioned on the tapered section of the wrist band and overlies the front side of the wrist when the band has been partially wrapped about the hand and wrist, as illustrated in FIG. 7. At this point, tab 31 is pulled to tension the palm section, then folded up and over the wrist band and to engage hook fastener 39 with loop fastener 38 to secure the tab to the wrist band, as illustrated in FIG. 8. Thereafter, the rest of the strap is wrapped about the wrist, over the folded up tab, and secured with the Velcro® fastener 36, 37 on the back side of the wrist. In this embodiment, the outermost convolution of the wrist strap overlies the tensioning tab and prevents the Velcro® fastener that secures the tab from working loose.

Figure 10:
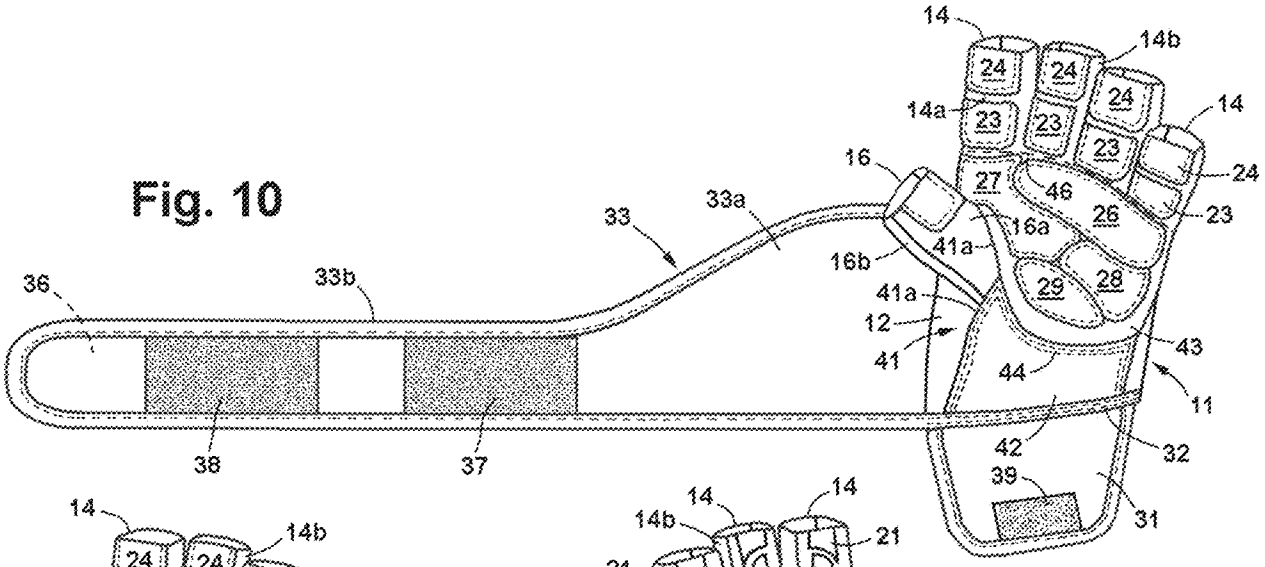
FIG. 10 is a front isometric view of another embodiment of a glove incorporating the invention.
Figure 12:
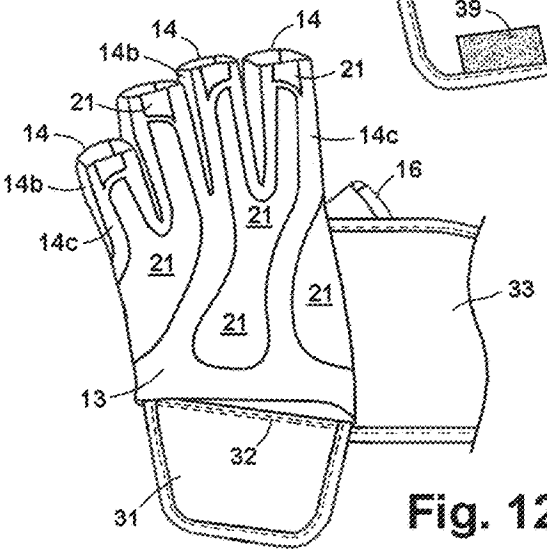
FIG. 12 is a fragmentary rear isometric view of the embodiment of FIG. 10.
Figure 11:
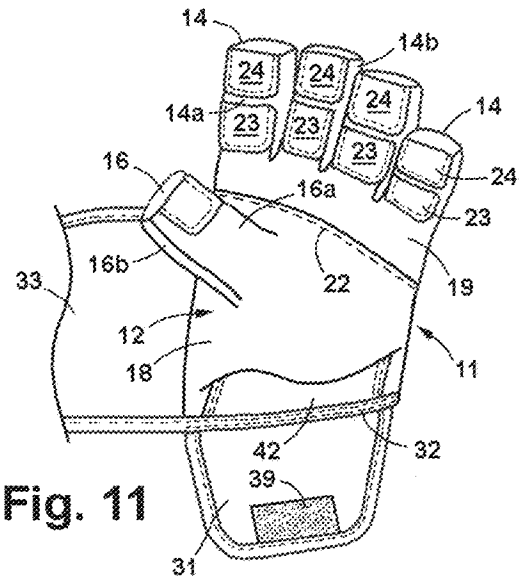
FIG. 11 is a fragmentary front isometric view of the body of the glove in the embodiment of FIG. 10.

In the embodiment of FIGS. 10-12, the glove has an outer panel 41 which overlies the palm section and carries pads 26-29.

As in the previous embodiments, the glove has a body 11 with a palm or front side 12 and a back side 13 which are shaped to conform generally to the palm and to the back of the user's hand. Finger stalls 14 extend from the upper portion of the body, and a thumb stall 16 extends from the front. The palm section has a lower section 18 fabricated of a non-stretchable material such as leather and an upper section 19 fabricated of a relatively thin, flexible or stretchable material such as a Lycra® fabric or other suitable material which extends to the tips of the finger stalls and forms the front walls or portions 14*a* of the finger stalls. The upper and lower palm sections are joined together by stitching 22 between the bases of the finger stalls and the transverse fold lines of the palm of a hand wearing the glove.

The sides 14*b* of the finger stalls and the back 16*b* of the thumb stall are fabricated of a stretchable material such as spandex, and the front 16*a* of the thumb stall is fabricated of the same non-stretchable material as the lower portion of the palm section. The back 13 of the glove body and the backs 14*c* of the finger stalls are fabricated of a continuous piece of elastic or stretchable material such as Lycra® fabric, with leather sections 21 over the stretchable material on the backs of the finger stalls and areas overlying the back of the hand below the finger stalls.

Outer panel 41 includes a substantially inelastic leather section 42 at the base of the palm and a stretchable section 43 of a material such as Lycra® fabric that overlies the rest of the palm, with the two sections being joined together by stitching 44. The lower edge portion of the leather section is attached to the lower edge portion of the lower palm section 18 of glove body 11 by stitching 32, and the upper edge portion of the stretchable section is attached to the upper palm section 19 of the glove body by stitching 46 just below the bases of the finger stalls.

Outer panel 41 is attached to the body of the glove along the ring finger side of the body, but is detached from the body along the thumb side of lower palm section 18, with a free edge 41*a* of the panel extending generally along the base of thumb stall 16. Being detached in this manner the outer panel is free to move relative to the palm section of the inner glove, with minimal friction on the surface of the skin on the palm. The outer panel pre-tensions the palm section and expands and contracts as the hand is curled and uncurled, gently drawing the hand toward the curled position to facilitate gripping of the object and minimizing excess slack materials in the palm of a curled glove.

Finger pads 23, 24 are attached to the front sides of finger stalls 14, as in the previous embodiments, but palm pads 26-29 are attached to the outer panel rather than the palm section. The pads are similar to the corresponding pads in the embodiment of FIG. 1 both in construction and in location on the hand.

As in the previous embodiments, a wrap strap 33 is attached to the body of the glove and extends laterally from the thumb side of the body, and a tab 31 for tensioning the palm section of the glove extends from the lower edge of the front side of the glove. In this embodiment, the tab is attached to the lower edge portions of both lower palm section 18 and outer panel 41 by stitching 32. Alternatively, if desired, the tab could be formed as an integral part of either the lower palm section or the lower section of the outer panel.

In this embodiment, the glove is placed on the hand in the same manner as the glove in the embodiment of FIG. 1. Thus, as illustrated in FIGS. 3-6, the wrist band is wrapped about the lower portion of the hand and about the wrist and secured with Velcro® fastener 36, 37. The tensioning tab is then pulled in a downward direction to tension both the palm section of the glove body and the outer panel, then folded up and over the wrist strap and secured with Velcro® fastener 38, 39.

Figure 13:
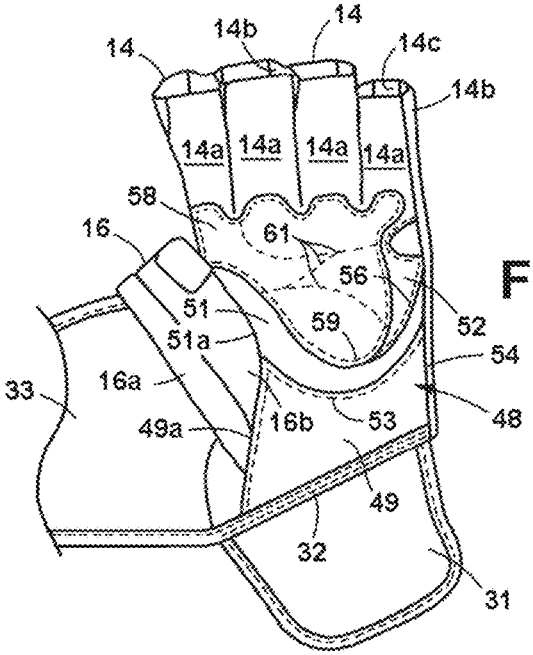
FIG. 13 is a front isometric view of another embodiment of a glove incorporating the invention.
Figure 14:
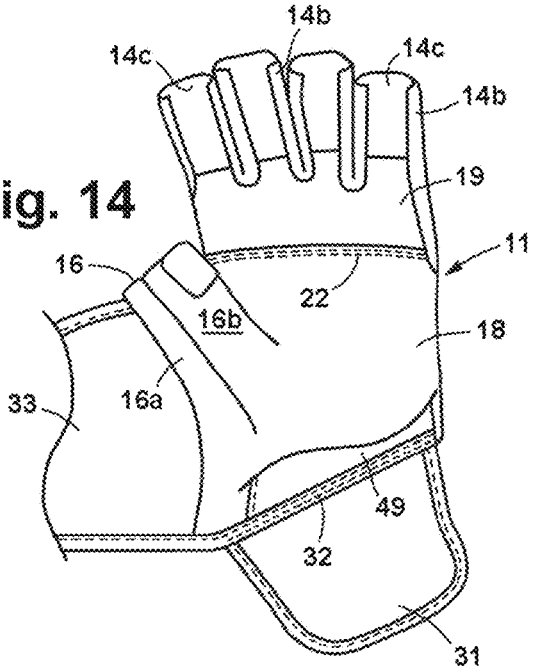
FIG. 14 is a fragmentary front isometric view of the body of the glove in the embodiment of FIG. 13.
Figure 15:
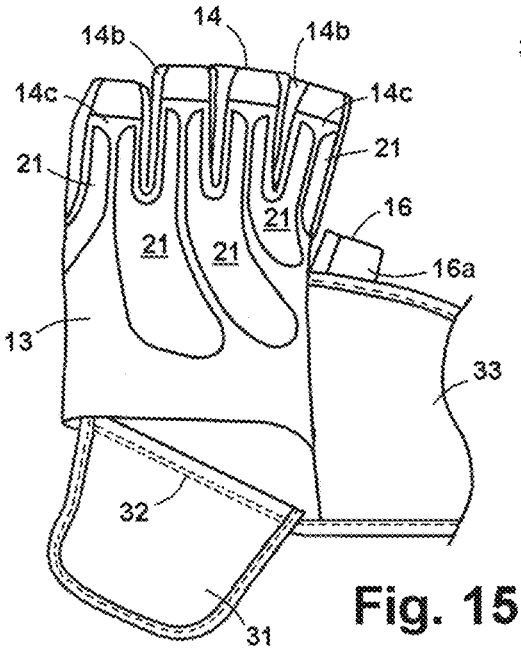
FIG. 15 is a fragmentary rear isometric view of the embodiment of FIG. 13.

The embodiment illustrated in FIGS. 13-15 is similar to the embodiment of FIGS. 10-12 in that it has an outer panel which overlies the palm side of the glove. In this embodiment, however, the stretchable upper section 19 on the palm side of the glove body terminates part way up the finger stalls, and the front walls 14*a* of the finger stalls are formed by the outer panel rather than being part of the body of the glove. Upper section 19 is attached to the upper edge portion of the substantially inelastic lower section 18 by stitching 22, and it is also attached to the lower portions of the side panels or fourchettes 14*b* of the finger stalls.

The back side of the glove in this embodiment consists primarily of a continuous piece of spandex 13 which extends from the lower edge of the glove to the tips of the finger stalls, with leather reinforcing strips 21 extending diagonally across the back of the hand and up the back walls 14*c* of the finger stalls. The back section 16*a* of the thumb stall is also spandex, and the front section 16*b* is the same substantially inelastic leather material as the lower section 18 of the palm side.

In this embodiment, outer panel 48 has a lower section 49 of substantially non-stretchable material such as leather, a middle section 51 of stretchable material such as Lycra fabric, and upper section 52 of substantially inelastic material such as leather, with the stretchable material of section 51 extending from the lower edge of the glove to the upper leather section 52. The lower leather section is attached to the stretchable material by stitching 32, 53, and by the seam 54 which extends along the little finger side of the glove. The upper leather section 52 is attached to the stretchable material by stitching 56.

The side edges 49*a*, 51*a* of lower leather section 49 and stretchable material 51 extend freely around the base of thumb stall 16. The upper section of substantially inelastic material 52 extends from the upper edge portion of the stretchable material to the tips of the finger stalls and forms the front walls 14*a* of the stalls. It also overlies the upper part of the palm and extends down into the lower section of the palm where it is spaced from the upper edge 49*a* of lower section 49 and side edge 51*a* of the stretchable section by a distance on the order of one-half inch. The upper section is attached to side panels 14*b* of the finger stalls and to the thumb and little finger sides of body 11 down to about the transverse fold lines of the palm. The relatively wide edge portion of the stretchable section that extends around the base of the thumb tends to ride higher on the thumb, rather than rolling over or under itself and interfering with movement of the thumb.

A pad 58 of grip enhancing and/or protective material such as leather is attached and overlies the palm portion of the upper section 52 of outer panel 48. This pad is attached to the upper section by peripheral stitching 59 and by interior stitching 61 which generally follows the fold lines of the palm.

As in the embodiment of FIGS. 10-12, the outer panel is free to move relative to the palm section of the glove body, to minimize friction on the surface of the skin on the palm. Here, also, the outer panel pre-tensions the palm section and expands and contracts as the hand is curled and uncurled, gently drawing the hand toward the curled position to facilitate gripping of the object.

In this embodiment, the glove is placed on the hand in the same manner as the glove in the embodiments of FIGS. 1 and 10. Thus, as illustrated in FIGS. 3-6, the wrist band is wrapped about the lower portion of the hand and about the wrist and secured with Velcro® fasteners 36, 37. The tensioning tab is then pulled in a downward direction to tension both the palm section of the glove body and the outer panel, then folded up and over the wrist strap and secured with Velcro® fastener 38, 39.

The embodiment shown in FIGS. 16-19 is similar to the embodiment of FIGS. 1-6 except it does not have Velcro® fasteners for securing the tensioning tab to the wrist band to maintain the desired tension in the palm section. Instead, it utilizes the curvature of the tab about the wrist and an over-center effect to retain the tab in position when it is folded over the wrist band.

When the glove is placed on the hand and wrist band 33 is secured about the wrist, tensioning tab 31 extends part of the way around the wrist with an arcuate curvature about the longitudinal axis of the wrist and the glove, as best seen in FIG. 17. When the tab is folded back over the wrist band, as shown in FIGS. 18 and 19, the curvature in the portion of the tab over the wrist band is opposite to what it was when the tab was extending straight out from the body of the gloved, as shown in FIG. 16.

Initially, the stresses produced by folding the tab about the curved edge of the wrist band resist the folding. However, as the folding continues, the stresses are overcome, and once the tab passes the center point, the effect of the stresses is reversed and thereafter they urge the tab toward the folded position over the wrist band. If the tab is wide enough, the curvature will keep it in the folded position so that the tension is maintained in the palm even without a fastener.

The invention has a number of important features and advantages. It protects the hand of a wearer and provides a better grip with minimal bunching up or gathering of material between the palm and the object, and the tensioning tab allows the individual user to tension the palm section of the glove to suit his particular needs.

While the invention has been described with specific reference to gloves having wrist supporting bands or straps, its use is not limited to such supports, and it can be employed with other types of gloves as well.

It is apparent from the foregoing that a new and improved glove for use in weightlifting and other activities involving the gripping of an object has been provided. While only certain presently preferred embodiments have been described in detail, as will be apparent to those familiar with the art, certain changes and modifications can be made without departing from the scope of the invention as defined by the following claims.

The invention claimed is:

1. A glove for gripping an object, comprising a palm section that overlies the palm side of the hand of person wearing the glove, a back section that overlies the back of the hand, stalls for receiving the fingers and thumb, a tab affixed to and extending from the lower margin of the palm section which can be pulled in a downward direction to tension the palm section, and means for holding the tab in a pulled position to maintain tension in the palm section.

2. The glove of claim 1 wherein the palm section is formed at least in part of an elastic material.

3. The glove of claim 1 wherein the means for holding the tab in a pulled position comprises a strap that wraps about the wrist and the lower portion of the palm section, with a portion of the tab being folded up over the strap and secured to the strap to maintain the tension in the palm section.

4. The glove of claim 3 wherein an outer convolution of the strap overlies the folded up portion of the tab to further secure the tab to the strap.

5. The glove of claim 1 including an outer panel formed at least in part of an elastic material which overlies the palm section and is attached to the tab for tensioning along with the palm section.

6. A glove for gripping an object, comprising an inner glove having a lower palm section of non-stretchable material and an upper palm section of stretchable material that overlie the palm side of the hand of person wearing the glove, a back section that overlies the back of the hand, and stalls for receiving the fingers and thumb; an outer panel formed at least in part of elastic material that overlies substantially all of the two palm sections and is attached to the inner glove along the upper and lower margins of the outer panel for drawing the hand toward a closed position for gripping an object; a tab extending from the lower margin of the palm section which can be pulled in a downward direction to tension the outer panel; and means for holding the tab in a pulled position to maintain tension in the outer panel.

7. The glove of claim 6 wherein the means for holding the tab in a pulled position comprises a strap that wraps about the wrist and across the lower portions of the outer panel and the palm section, with a portion of the tab being folded up over the strap and secured to the strap to maintain the tension in the outer panel.

8. The glove of claim 7 wherein the tab is secured to the strap with a hook and loop fastener.

9. The glove of claim 7 wherein an outer convolution of the strap overlies the folded up portion of the tab to further secure the tab to the strap.

10. The glove of claim 6 wherein the outer panel extends from the lower edge of the lower palm section of the inner glove to the tips of the finger stalls and forms the front walls of the finger stalls.

11. The glove of claim 10 wherein the outer layer is attached to the inner glove along the little finger side of the glove and detached from the thumb side of inner glove between the lower edge of the lower palm section of the inner glove and the transverse fold lines of the palm.

12. The glove of claim 11 including grip enhancing pads on the portion of the outer panel that overlies the palm and on the portions that form the front walls of the finger stalls.

13. The glove of claim 11 wherein the upper palm section of the inner glove extends to the tips of the finger stalls, and the outer panel terminates at the base of the finger stalls.

14. The glove of claim 13 wherein the outer layer is detached from both the thumb side and the little finger side of inner glove between the lower edge of the lower palm section and the transverse fold lines of the palm.

15. The glove of claim 13 including grip enhancing pads on the outer panel and the finger stalls for engagement with the object.

16. A glove for gripping an object, comprising an inner glove having stalls for receiving the fingers and thumb of a hand wearing the glove, a lower palm section of non-stretchable material that overlies the lower portion of the palm, an upper palm section of stretchable material that overlies the upper portion of the palm and extends to the tips of the finger stalls, and a back section that overlies the back of the hand; an outer panel of elastic material that overlies substantially the entire palm and is attached to the inner glove along the base of the lower palm section and the base of the finger stalls for drawing the hand toward a closed position for gripping an object; a tab extending from the lower margin of the palm section which can be pulled in a downward direction to tension the outer panel, and means for holding the tab in a pulled down position to maintain tension in the outer panel.

17. The glove of claim 16 wherein the means for holding the tab in a pulled position comprises a strap that wraps about the wrist and across the lower portions of the outer panel and the palm section, with a portion of the tab being folded up over the strap and secured to the strap to maintain the tension in the outer panel.

18. The glove of claim 17 wherein the tab is secured to the strap with a hook and loop fastener.

19. The glove of claim 17 wherein an outer convolution of the strap overlies the folded up portion of the tab to further secure the tab to the strap.

20. The glove of claim 16 wherein the outer layer is detached from both the thumb side and the little finger side of inner glove between the lower edge of the lower palm section and the transverse fold lines of the palm and is attached to both sides of the inner glove between the transverse fold lines and the base of the finger stalls.

21. The glove of claim 16 including grip enhancing pads on the outer panel and the finger stalls for engagement with the object.

22. A glove for gripping an object, comprising an inner glove having a lower palm section of non-stretchable material that overlies the lower portion of the palm of a hand wearing the glove, an upper palm section of stretchable material that overlies the upper portion of the palm, a back section that overlies the back of the hand, and stalls for receiving the fingers and thumb; an outer panel of elastic material that is attached to the lower portion of the lower palm section of the inner glove, overlies substantially the entire palm, and extends to the tips of the finger stalls, forming the front walls of the finger stalls and drawing the hand toward a closed position for gripping an object; a tab extending from the lower margin of the palm section which can be pulled in a downward direction to tension the outer panel, and means for holding the tab in a pulled position to maintain tension in the outer panel.

23. The glove of claim 22 wherein the means for holding the tab in a pulled position comprises a strap that wraps about the wrist and across the lower portions of the outer panel and the palm section, with a portion of the tab being folded up over the strap and secured to the strap to maintain the tension in the outer panel.

24. The glove of claim 23 wherein the tab is secured to the strap with a hook and loop fastener.

25. The glove of claim 23 wherein an outer convolution of the strap overlies the folded up portion of the tab to further secure the tab to the strap.

26. The glove of claim 22 wherein the outer layer is attached to the little finger side and detached from the thumb side of the inner glove between the base of the lower palm section and the base of the finger stalls.

27. The glove of claim 22 including grip enhancing pads on the outer panel and the finger stalls for engagement with the object.

28. A glove for gripping an object, comprising a palm section that overlies the palm side of the hand of person wearing the glove, a back section that overlies the back of the hand, stalls for receiving the fingers and thumb, and a tab extending from the lower margin of the palm section which can be pulled in a downward direction to tension the palm section, and a strap that wraps about the wrist and the lower portion of the palm section, with a portion of the tab being folded up over the strap to hold the tab in place and maintain the tension in the palm section.

29. The glove of claim 28 wherein the portion of the tab folded over the strap is secured to the strap by a fastener.

30. The glove of claim 28 wherein the portion of the tab folded over the strap is curved about the wrist with a curvature that holds the tab in the folded position.

31. The glove of claim 1 wherein the tab is affixed to the lower margin of the palm section by stitching.

32. The glove of claim 1 wherein the tab is affixed to the lower margin of the palm section by being formed integrally with the palm section.

* * * * *